US006974131B2

(12) United States Patent
Frank

(10) Patent No.: US 6,974,131 B2
(45) Date of Patent: Dec. 13, 2005

(54) BOARD GAME INCORPORATING FEAST PREPARATION

(76) Inventor: John Frank, 4624 Curtiss Dr., Virginia Beach, VA (US) 23455

( * ) Notice: Subject to any disclaimer, the term of this patent is extended or adjusted under 35 U.S.C. 154(b) by 0 days.

(21) Appl. No.: 10/191,462

(22) Filed: Jul. 10, 2002

(65) Prior Publication Data

US 2004/0032081 A1 Feb. 19, 2004

Related U.S. Application Data

(60) Provisional application No. 60/373,608, filed on Apr. 19, 2002.

(51) Int. Cl.[7] ..... A63F 3/00

(52) U.S. Cl. ..... 273/249; 273/243

(58) Field of Search ..... 273/242, 243, 273/248, 251, 252, 253, 254, 287, 249, 259, 277

(56) References Cited

U.S. PATENT DOCUMENTS

| | | | | |
|---|---|---|---|---|
| 3,191,184 A | | 6/1965 | Durstewitz | |
| 3,582,070 A | | 6/1971 | Breslow | |
| 3,799,550 A | * | 3/1974 | Milana et al. | 273/243 |
| 4,065,131 A | * | 12/1977 | Martin et al. | 273/243 |
| 4,398,721 A | | 8/1983 | McKay | |
| 4,948,146 A | | 8/1990 | Snyder et al. | |
| 5,071,134 A | * | 12/1991 | Burroughs, Jr. | 273/249 |
| 5,080,369 A | | 1/1992 | Mongno | |
| 5,251,904 A | * | 10/1993 | Cruz | 273/243 |
| 5,676,369 A | | 10/1997 | DeWeese | |
| 5,882,008 A | * | 3/1999 | Siegesmund | 273/249 |
| 5,941,526 A | | 8/1999 | Martens et al. | |
| 6,273,425 B1 | * | 8/2001 | Westfall et al. | 273/459 |
| 6,279,909 B1 | | 8/2001 | Alexander, II et al. | |
| 6,287,560 B1 | | 9/2001 | Fujii | |

OTHER PUBLICATIONS

Ex.Parte Breslow 192 USPQ431.*

* cited by examiner

*Primary Examiner*—Vishu K. Mendiratta
(74) *Attorney, Agent, or Firm*—Merek, Blackmon & Voorhees, LLC

(57) ABSTRACT

A board game which combines traditional board game elements with an unrelated activity, that of preparing a meal. The board has three paths of serially arranged spaces along which player tokens travel. A chance device determines the number of spaces moved. Upon alighting on any particular space, a card is drawn, which card is color coordinated to the space just occupied. The card specifies an interactivity such as a question to be answered or a musical theme to be tapped, hummed or whistled. The player must interactively respond. Upon completion of the first path, players select, on a first-to-arrive basis, a task associated with meal preparation, serving, and cleanup. An example is mixing and serving of a beverage, or cooking the entree. One option is to be relieved of any task. Upon completion of the path by his or her token, each player receives an instructional card advising details of the associated task. The game is played in three phases, each utilizing one path and corresponding to three phases of a meal, such as appetizer, entree, and dessert. Optionally, invitations to a combined meal and game are sent prior to the event by postcard.

19 Claims, 4 Drawing Sheets

TOAST MASTER (a free roll card)

Select a teammate who will provide the toast. Follow the instructions on the back of this card. 36

Upon completion of the toast, roll 1 die and advance accordingly.

38

FIG 2

TOAST MASTER (a free roll card) 38

Please read the toast out loud. Then provide an original toast by filling in the blanks. 40

Here's to the music of_____which always seems to get me in a_____mood.

FIG 3

CONFECTION REFLECTION

48

Please read the thought-provoking question on back of this card out loud to all participants. 44

Take a moment to reflect, and then provide your response within a 30 second interval.

FIG 4

CONFECTION REFLECTION

If you can have dinner with any living person in the world, who would it be and why?

46 48

FIG 5

APPETIZER CHEF 50

This card is for the player that ended in the " Appetizer Chef" block following the finish line in Round 1. Please move into the kitchen to prepare tonight's quesadillas by completing the instructions on the back of this card.

FIG 8

APPETIZER CHEF INSTRUCTIONS 52

Preheat oven to 400 degrees.
Mix pre-browned beef with refried beans and taco seasoning in large bowl.
Lay 4 tortillas on foil covered in large bowl.
Spread bean/beef mixture on each tortilla.
Sprinkle with cheddar cheese and top with another tortilla.
Bake 7-10 minutes until warm.
Slice into quarters and serve with salsa.
When finished, notify the wait staff to serve.

FIG 9

From: _____

Place Stamp Here

To: _____

FIG 10

46

Please join for an evening of fun and dining as we play a board game that results in a meal.

Please bring the following:

_____

FIG 11

BOARD GAME INCORPORATING FEAST PREPARATION

REFERENCE TO RELATED APPLICATION

This application claims priority benefit of Provisional Patent Application Ser. No. 60/373,608, filed Apr. 19, 2002.

BACKGROUND OF THE INVENTION

1. Field of the Invention

The present invention relates to games, and more particularly to a game which combines traditional board game elements and an unrelated activity such as preparing a meal. Steps of the unrelated activity are melded into steps of playing the game.

2. Description of the Prior Art

Parlor games such as board games have become a favored way of passing time sociably with friends and acquaintances. Parlor games enable participants to pass time pleasurably while escaping from pressures and demands of day to day living. Sociable gatherings also frequently center about meals. Meals provide an enjoyable activity in which conversation usually plays a significant role. When the purpose of a meal is to foster social interaction as well as for mere nourishment, beverages, particularly alcoholic beverages are usually available.

The role of host in gatherings can be quite time consuming, especially where significant time must be devoted to preparation and serving of food and beverages. This can interfere with the host's attention to and interaction with guests. One approach to freeing a host to interact with the guests is to engage the services of others such as servants or persons engaged for one gathering. However, it is not always economically feasible and may not be desirable to introduce additional people into a household during a social event. It is desirable to accomplish the diverse tasks related to food and beverage preparation while enabling hosts to interact with guests.

It will further be appreciated that both parlor games and meals are significant elements of certain social gatherings. It would be desirable to combine these two disparate elements of a social gathering into one.

SUMMARY OF THE INVENTION

The present invention addresses the need of combining entertaining activities, such as parlor games, with food and beverages typically provided at social gatherings. It also addresses the problem of accommodating the conflicting demands on the time and attention of hosts.

To these ends, there is set forth a board game which incorporates at least some of the tasks associated with a feast or other social gathering. Specifically, individual tasks in preparing food and beverages are apportioned among the players of the game as steps of the game. Tasks can thereby be relatively evenly divided among those present at the gathering, and may be performed in a social setting.

The novel game includes a board game, player tokens or pieces which are moved along spaces arranged in paths on the board, dice for determining progress of each player piece at each turn or move, and cards bearing instructions. Several categories of cards are provided. Activity cards which are color coordinated with spaces on the board require an action by each player landing on a space associated with the cards. For example, an activity card may bear a question requiring a response. A correct answer to a question appearing on an activity card entitles the player to proceed. Arrival at the end of each path determines, by order of finishing, which players perform which tasks associated with preparation of food and beverages. Instruction cards are provided to guide each player in accomplishing his or her tasks. Preferably, there are three paths which are to be negotiated by all players, with each path corresponding to one course of the feast. This affords the players to assume different roles in preparation of food and beverage as play progresses. It will be seen that participation in the game by both guests and hosts accomplishes the dual purposes of preparing and serving a meal while promoting social interaction among the participants.

This and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a plan view of the obverse of a first variety of an activity card which is part of the game apparatus.

FIG. 3 is a plan view of the reverse of the activity card of FIG. 2.

FIG. 4 is a plan view of the obverse of a second variety of an activity card which is part of the game apparatus.

FIG. 5 is a plan view of the reverse of the activity card of FIG. 4.

FIG. 8 is a plan view of the obverse of a first variety of an instructional card which is part of the game apparatus.

FIG. 9 is a plan view of the reverse of the instructional card of FIG. 8.

FIG. 10 is a plan view of the obverse of a postcard which is optionally utilized as an invitation for the novel game.

FIG. 11 is a plan view of the reverse of the postcard of FIG. 10.

DETAILED DESCRIPTION OF THE PREFERRED EMBODIMENTS

Figure 1:
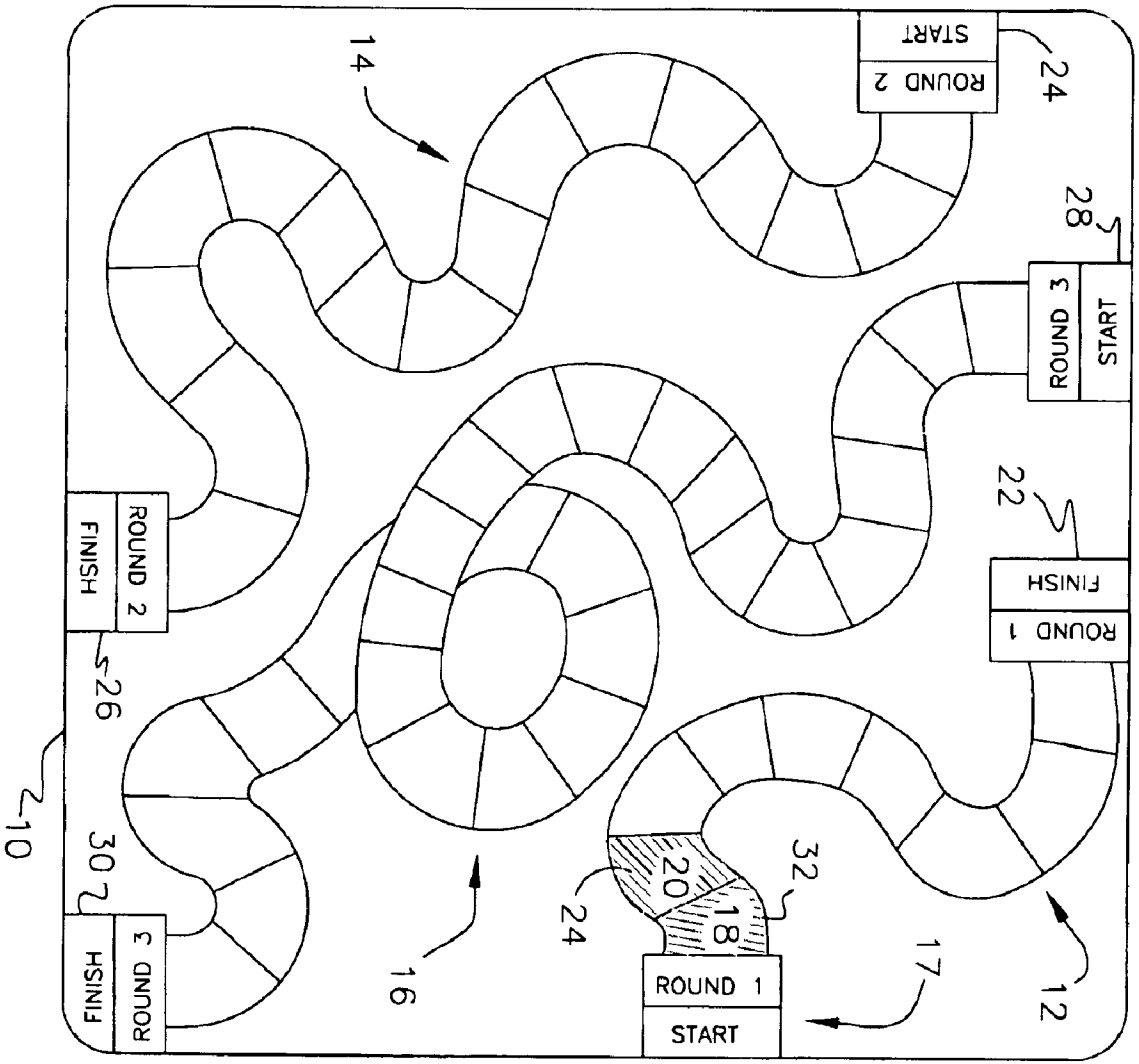
FIG. 1 is a plan view of the board apparatus.

Turning now to FIG. 1 of the drawings, the game apparatus includes a board 10 which bears a plurality of position spaces arranged serially in three progressions or paths 12, 14, 16. Tokens or player pieces (not shown) are to be moved along paths 12, 14, 16 by alighting upon and occupying a position space. The exact number of spaces of movement is determined by a number generating device, for example, a chance device such as a die or dice (not shown). A player piece may be, for example, a miniature figurine or any small object which is readily placed on and occupies any position space of paths 12, 14, 16. Player pieces are well known in board games wherein a representative token for each player is to be moved along and occupy serially arranged spaces on a board, and hence will not be described in greater detail herein. Dice and other chance devices such as spinners are equally well known and hence will not be described.

Figure 6:
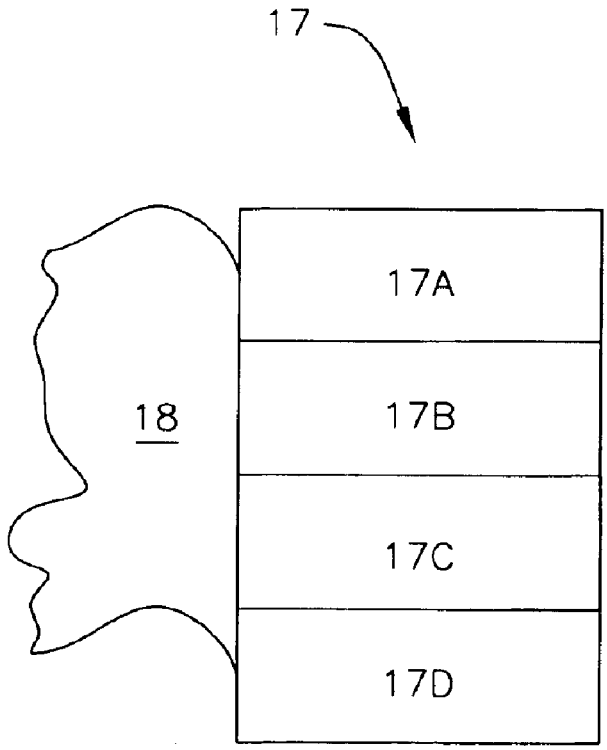
FIG. 6 is an enlarged detail view of a space seen at the right center of the board, as depicted in FIG. 1, seen in plan view.

Path 12 is seen to have an initial or starting space 17, which for convenience in accommodating a plurality of player pieces may be divided into a plurality of sections 17*a*, 17*b*, 17*c*, 17*d* (see FIG. 6). Division of space 17 into sections enables an intuitive grasp of how to prepare to play, and has no significance regarding progress along path 12 or regarding competitive advantage. The same holds true for that section shown in FIG. 1 bearing the legend "Round 1". Space 17 abuts a space 18, which in turn abuts a space 20.

It will be seen that path 14 has a starting space 24 and a final or finish space 26, and that path 16 has a starting space 28 and a finish space 30. The game is played in three phases, each phase corresponding to one path 12, 14, or 16. The goal of the game is to be the first player to advance from the starting space (e.g., space 17 of path 12) to the finish space (e.g., space 22 of path 12) in each of the three phases.

The embodiment depicted and described herein utilizes three paths 12, 14, 16, and accommodates four player pieces. Each player piece represents either a single person or a group or team, such as a couple. Each player, or one representative from each team, operates the chance device, which in the preferred embodiment is dice, to determine order of play. When order of play is determined, the first player throws the dice and advances along path 12 starting from starting space 17 according to the count determined by the dice. The number of spaces (e.g., spaces 18 and 20 and succeeding spaces) corresponds to the throw of the dice.

It will be seen that space 18 bears brown coloring 32 and that space 20 bears green coloring 34. Similarly, all succeeding spaces bear coloring (not indicated). Preferably, there are at least four colors provided. The spaces of paths 14 and 16 are similarly treated with coloring. Upon having his or her playing piece alight on any space as a result of a move or turn, the player who has made the move draws an activity card. The obverse of an exemplary activity card 36 is shown in FIG. 2. It will be seen that activity card 36 bears coloring 38 which is coordinated with, preferably being identical to, one of the colors borne by spaces of path 12. In the present example, coloring 38 is similar or identical to coloring 32 of space 18. The player whose playing piece has alighted on space 18 must draw a card from a plurality of cards bearing similar coloring.

There are a plurality of varieties of activity cards, each variety being associated with a different type of activity and containing instructions to perform an activity such as providing a verbal response to an inquiry. Illustratively, activity card 36 is associated with toasting. To perform the activity associated with card 36, the player who has drawn card 36 turns to the reverse side 40 of card 36. As seen in FIG. 3, reverse side 40 bears indicia corresponding to an instruction to complete a toast, basic elements of which are suggested on card 36. Completion of the activity specified on card 36 entitles the player to roll 1 die and move his or her playing piece along path 12, accordingly. Alternatively, an activity card may require the player drawing the same to move his or her player piece by a specified number of spaces forwardly or backwardly. Some activity cards may not affect position of the player piece on the board.

FIG. 4 shows a second variety of activity card. Card 42 has an obverse side 44 bearing indicia corresponding to instructions. Reverse side 46 of card 42 (see FIG. 5) poses a question which is to be answered by the player who has drawn card 42. Card 42 bears coloring 48 corresponding to coloring 34 of space 20 of board 10. A player whose playing piece alights upon space 20, or any other space bearing similar coloring, must draw one card from a plurality of that variety of activity cards which bears similar coloring. The player must follow directions appearing upon the drawn card.

This principle is followed for all spaces of path 12, wherein all spaces bear one of the colors associated with each variety of activity cards. Two further exemplary varieties of activity cards include one variety dedicated to music and one variety dedicated to questions relating to trivia. That variety dedicated to music requires the player drawing the card to select a melody from several presented on the card, and to hum, whistle, tap the beat of that melody, or otherwise reproduce aspects of the specified melody without uttering any words associated with the melody, so that other players can identify the melody. The player drawing the card and the first player to successfully identify the melody are permitted to advance along the board according to instructions borne on the card.

The variety of cards dedicated to trivia preferably relate to the theme of the present game, namely, food or beverages. The player drawing the card reads a question appearing upon the card and if successfully answering within a predetermined time interval, such as thirty seconds, is permitted to advance along the board.

Neither one of the further exemplary varieties is shown. These further varieties are provided as part of the game apparatus to increase the number of varieties of activities, so that ability of participants to satisfy demands of the activity cards does not favor any player or players who are particularly able in just one field of knowledge. The additional fields of knowledge and endeavor have a tendency to even out individual performances when responding to an activity card. It will be appreciated that the number of varieties of activity cards correlates to the number of different colors borne by the spaces of board 10.

Optionally, reverse side 40 of card 36 may bear coloring 38 which is identical to that seen on the obverse side. This promotes ready organization of the cards prior to playing the game or thereafter.

Figure 7:
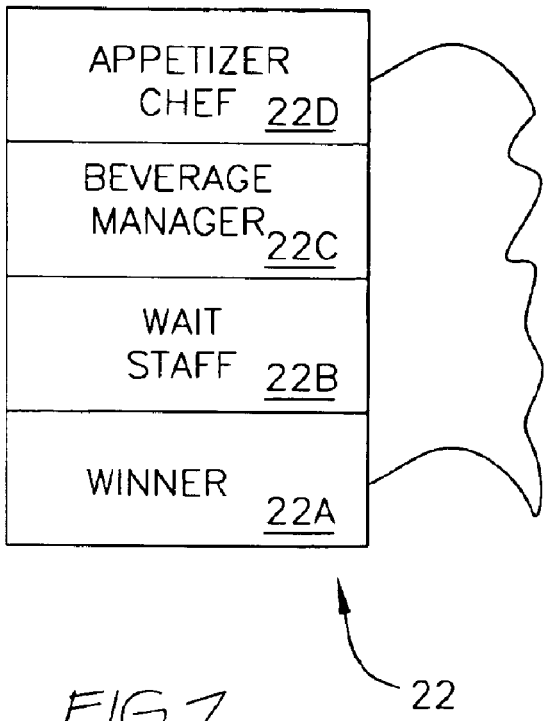
FIG. 7 is an enlarged detail view of a space seen at the upper center of the board, as depicted in FIG. 1, seen in plan view.

Play proceeds with each player or team taking a turn to move according to the order established at the beginning of the game. The first player to arrive at finish space 22 of path 12 may select among the options shown in FIG. 7. Arrival at finish space 22 signifies either alighting directly on finish space 22 or alternatively, passing finish space 22 as a result of the numerical value indicated by the number generator. In FIG. 7, it is seen that finish space 22 is subdivided into four sections, one section 22*a* being designated "Winner", a second section 22*b* being designated "Wait Staff", a third section 22*c* being designated "Beverage Manager", and the final section being designated "Appetizer Chef". Players arriving at finish space 22 after the first player to do so may select among the remaining options as they arrive at finish space 22, and are thus deprived of options selected prior to their arrival. The last player to arrive at finish space 22 must move immediately, by default, without utilizing the chance device, to the space corresponding to the final available option. Of course, spaces other than finish space 22 could be designated as being associated with performing a step in preparing food or beverage or both, rather than or in addition to finish space 22 being so designated.

The legends designated on the various sections of finish space 22 relate to the role to be played by that player whose playing piece occupies the corresponding section 22*a*, 22*b*, 22*c*, or 22*d*. The player designated "Winner" is relieved of the necessity to perform any chore related to preparing food or beverage or both. The others must assume responsibilities associated with their respective designated roles. As exemplified in FIGS. 8 and 9, each of the participants having responsibilities relating to preparation of food or beverage is given an instructional card. The instructional card directs the player drawing the same to perform a step in the preparation of food or beverage or both to be consumed during the gathering associated with the game, and further provides specific instructions regarding a particular item of food or beverage. As employed herein, preparation encompasses cleaning and other ordinary activities that would be performed by professional wait staff, including, for example, removing dishes, drinking glasses, and any waste associated with food and beverages generated during the game.

An exemplary card 50 bears instructions for the responsibility to be assumed by that player drawing card 50. General instructions relating to the role appear on the obverse side of instructional card 50. Specific instructions, in this example, relating to one of the predetermined comestibles to be prepared as part of the feast, are shown on the reverse side 52 of card 50. Different instructions are provided for the roles of "Wait Staff" and "Beverage Manager".

Once all of the participants have negotiated first path 12 and have completed the duties associated with their respective roles, the food and beverages that have been prepared are consumed. Play at board 10 then resumes, with the participants utilizing the spaces of path 14. The rules of play for the second phase, that utilizing path 14, are similar to those which apply to the first phase. At the conclusion of board play of the second phase, the entree is prepared by a protocol similar to that which applied to the appetizers prepared at the conclusion of the first phase of play. Roles and instructions appropriate to an entree of a meal must obviously differ from those for appetizers, but the same general principles prevail.

The overall principles are again repeated for the third phase of play, that employing the spaces of path 16 and culminating in preparation of dessert. Again, roles and instructions for dessert differ from those appropriate for appetizers and entrees.

Preferably, a pamphlet of instructions (not shown) is provided for explaining the game. Because preparation of a full meal may prove a considerable undertaking, the instructions preferably list all ingredients which may be required in order to follow preparation instructions, estimate time required to complete preparation of portions of the meal, and may provide directions advising the host as to what must be done to maintain expeditious progress throughout the game, as well as stating the rules of play.

It will be apparent that different meals may be prepared utilizing the same board, which is generic with regard to types of food. To this end, alternative sets of activity cards and instructional cards may be provided or made available. The alternative sets of cards differ in the recipes, types of food, and to some extent, roles, but will follow the same method of play as that set forth above.

Optionally, the game apparatus includes a plurality of postcards, a representative postcard 54 being illustrated in FIG. 10. Postcards are provided as invitations which may be mailed to prospective guests. Apart from the conventional return address lines, destination address lines, and indication of a preferred location for affixing for postage, all shown on the obverse side 56 of postcard 54, there is indicia 58 corresponding to the actual invitation, including for example announcement of a social gathering and playing of an associated board game, and blank lines 60 for entering specific supplies which may be requested of the various guests. Requesting guests each to bring some of the required supplies reduces burden on the host, although the latter may be willing to provide all necessities if desired. Although it is most practical that invitations be configured as postcards, as depicted in FIG. 10, they may take any form configured as mail.

Certain aspects of the preferred embodiments may be modified without departing from the inventive concept. For example, color coordinating cards and spaces can be modified to employ any visual similarity other than color. For example, spaces and cards may bear similar pictorial devices, border decoration, or other visually distinguishable characteristics readily enabling activity cards to be visually associated with their respective position spaces.

The number of players and phases, where the latter refers to courses and paths of serially arranged playing spaces, may be varied to suit.

The game apparatus need not literally comprise a board. Conventional game boards are formed from paper or cardboard stock, and are imprinted with an image containing position spaces, instructions, and other indicia necessary or desirable to the play of the game. While a conventional game board is seen as the preferred embodiment, the novel game may be played utilizing any surface provided with an image of at least one path comprising sequentially disposed position spaces. The image could be painted or otherwise inscribed upon the surface of furniture, countertops, a flaccid material such as a blanket or section of plastic sheet, or any other object. Alternatively, the image could be projected onto a screen, a wall, or other surface, or could be provided as a dynamic display, such as a cathode ray tube, a flat screen display, other apparatus enabling visible reproduction of images, or a combination of these. To play the game, it is merely necessary to make an image of the path of position spaces visible to the participants. Similarly, the player pieces may take any form appropriate to the medium displaying the image of the path or paths.

Arrangements other than a chance device may be employed for determining the number of spaces to be negotiated during a move. For example, cards (not shown) bearing numerical values may be drawn in lieu of dice being thrown or a spinner being operated. Mental calculations and operations may be substituted for mechanical apparatus determining a number. For example, the digits of the year of one's birth, one's Social Security number, address, or of other significance to a player may be summed until one digit remains, that digit determining magnitude of a move of a player piece. This may be done by moving the piece by the exact numerical value shown, or by using the numerical value in some other way, as long as the number generator ultimately determines magnitude of each move of a player piece along the board.

An automatic device such as a digital random number generator may be employed, particularly where the game is rendered in digital fashion, with the image being provided on a cathode ray tube or other display. The method of generating numbers for moving player pieces is not critical to the game.

It will be appreciated that activity cards and instructional cards bearing instructions may be replaced or supplemented by any suitable medium for conveying the subject matter. Therefore, any indicia bearing member, including dynamic displays or even audible devices, will be regarded as equivalent to paperboard cards.

It is to be understood that the present invention is not limited to the embodiments described above, but encompasses any and all embodiments within the scope of the following claims.

I claim:

1. A method of playing a game which incorporates therein steps of preparing food, said game comprising the steps of:

providing game apparatus including an image of a path comprising sequentially disposed position spaces including a first space and a final space, a plurality of player pieces to be moved along the path by selectively alighting on the position spaces, wherein each player piece represents a player comprising at least one person, and a number generating device operable to indicate a numerical value;

providing food suitable for preparation by at least one player into a preselected meal;

dividing recipe for making the preselected meal into a number of discrete preparation steps;

causing the players to move by using the number generating device to determine a numerical value and moving that player piece associated with the player who is moving to progress along the path according to the determined numerical value;

designating a particular space along the path as being associated with performing at least one of the discrete preparation steps; and requiring a player alighting on the particular space in the course of a move to perform a step in the preparation of said meal by manipulating at least a portion of the food in completion of at least one of the recipe preparation steps.

2. The method according to claim 1, wherein said step of requiring a player alighting on the particular space to perform a step in the preparation of the meal comprises the further step of requiring that the player alight on the final space of the path prior to performing the step in the preparation of food or beverage or both.

3. The method according to claim 1, comprising the further step of causing the first player to alight on the particular space to choose among a plurality of choices of different steps in the preparation of the meal.

4. The method according to claim 1, comprising the further step of causing the first player to alight on the particular space to choose among a plurality of choices of different steps in the preparation of the meal, said further step including the option to be relieved of preparing the meal.

5. The method according to claim 4, comprising the further step of depriving a subsequent player to alight on the particular space of an option selected by a prior player to alight upon the particular space.

6. The method according to claim 1, comprising the further steps of providing game apparatus including a plurality of instructional indicia bearing members each containing instructions to perform a step in the preparation the meal, and requiring that player alighting on the particular space to perform a step in the preparation of the meal according to instructions of the instructional indicia bearing members.

7. The method according to claim 1, including the further step of determining the order in which the players each take their respective turns to move.

8. The method according to claim 1, wherein said step of causing the players to move by using the number generating device comprises the further step of requiring the player piece of each player to move along the path a number of position spaces equal to the numerical value obtained using the number generating device.

9. The method according to claim 1, comprising the further steps of providing game apparatus including activity instructional indicia bearing members each containing instructions to perform an activity, visually associating each one of said activity instructional indicia bearing members to be visually associated with at least one of the position spaces of the path, and requiring each player to draw one of and perform the activity specified on the drawn activity instructional indicia bearing member.

10. The method according to claim 1, comprising the further steps of providing an image of at least one additional path comprising additional sequentially disposed position spaces including a first space and a final space, and causing the players to move along each one of the additional paths by using the number generating device to determine a numerical value and moving that player piece associated with the player who is moving to progress along the path according to the determined numerical value, after all players have completed negotiating the first path.

11. The method according to claim 10, comprising the further steps of designating a particular space along each additional path as being associated with performing a step in the preparation of the meal; and requiring a player alighting on the particular space of each additional path in the course of a move to perform a step in the preparation of the meal which is different from a step in the preparation of the meal associated with a prior path.

12. A method of playing a game which incorporates therein steps of preparing food or beverages or both, said game comprising the steps of:

providing a game apparatus including an image of a path comprising sequentially disposed position spaces including a first space and a final space; a plurality of player pieces to be moved along the path by selectively alighting on the position spaces, each said player piece representing a player comprising at least one person; and a number generating device operable to indicate a numerical value;

causing the players to move by using said number generating device to determine a numerical values and moving that player piece associated with the player who is moving to progress along the path according to said determined numerical value;

associating a particular space along the path with performing a preparation step on the food or beverage or both;

causing the player alighting on the particular space in the course of a move to perform said preparation step on the food or beverage or both; and causing the first player to alight on a particular space to choose among a plurality of choices of different steps in the preparation of the food or beverage or both.

13. The method according to claim 12, comprising the further step of depriving a subsequent player to alight on the particular space of an option selected by a prior player to alight upon the particular space.

14. A method of playing a game which incorporates therein steps of preparing food or beverages or both, said game comprising the steps of:

providing game apparatus including an image of a path comprising sequentially disposed position spaces including a first space and a final space, a plurality of player pieces to be moved along the path by selectively alighting on the position spaces, wherein each player piece represents a player comprising at least one person, and a number generating device operable to indicate a numerical value;

causing the players to move by using the number generating device to determine a numerical value and moving that player piece associated with the player who is moving to progress along the path according to the determined numerical value;

designating a particular space along the path as being associated with performing a step in the preparation of food or beverage or both;

requiring a player alighting on the particular space in the course of a move to perform a step in the preparation of food or beverage or both; and wherein said step of requiring a player alighting on the particular space to perform a step in the preparation of food or beverage or both comprises the further step of requiring that the player alight on the final space of the path prior to performing the step in the preparation of food or beverage or both.

15. The method according to claim 14, comprising the further step of causing the first player to alight on the particular space to choose among a plurality of choices of different steps in the preparation of food or beverage or both.

16. The method according to claim 14, comprising the further step of causing the first player to alight on the particular space to choose among a plurality of choices of different steps in the preparation of food or beverage or both, said further step including the option to be relieved of preparing food or beverage or both.

17. The method according to claim 16, comprising the further step of depriving a subsequent player to alight on the particular space of an option selected by a prior player to alight upon the particular space.

18. The method according to claim 14, comprising the further steps of providing game apparatus including a plurality of instructional indicia bearing members each containing instructions to perform a step in the preparation of food or beverage or both, and requiring that player alighting on the particular space to perform a step in the preparation of food or beverage or both according to instructions of the instructional indicia bearing members.

19. The method according to claim 14, comprising the further steps of providing game apparatus including activity instructional indicia bearing members each containing instructions to perform an activity, visually associating each one of said activity instructional indicia bearing members to be visually associated with at least one of the position spaces of the path, and requiring each player to draw one of and perform the activity specified on the drawn activity instructional indicia bearing member.

* * * * *